US005875635A

United States Patent [19]

Platell

[11] Patent Number: 5,875,635

[45] Date of Patent: Mar. 2, 1999

[54] ARRANGEMENT OF A STEAM ENGINE POWER PLANT

[75] Inventor: Ove Platell, Sigtuna, Sweden

[73] Assignee: Ranotor Utvecklings AB, Sigtuna, Sweden

[21] Appl. No.: 750,832

[22] PCT Filed: Jun. 19, 1995

[86] PCT No.: PCT/SE95/00755

§ 371 Date: Dec. 19, 1996

§ 102(e) Date: Dec. 19, 1996

[87] PCT Pub. No.: WO95/35430

PCT Pub. Date: Dec. 28, 1995

[30] Foreign Application Priority Data

Jun. 20, 1994 [SE] Sweden ..... 9402182

[51] Int. Cl.[6] ..... F01K 3/00

[52] U.S. Cl. ..... 60/659

[58] Field of Search ..... 60/713, 659, 652

[56] References Cited

FOREIGN PATENT DOCUMENTS

| | | |
|---|---|---|
| 179217 | 12/1906 | Germany . |
| 186983 | 7/1907 | Germany . |
| 360122 | 9/1922 | Germany . |
| 90/09512 | 8/1990 | WIPO . |

*Primary Examiner*—Noah P. Kamen

*Attorney, Agent, or Firm*—Jacobson, Price, Holman & Stern, PLLC

[57] ABSTRACT

An arrangement for a steam engine power plant with a steam generator, a steam buffer, and a timing valve for a steam engine of a displacement type with a range of cut-offs and motion in both driving and braking directions. Engine braking to the steam engine is provided when the timing valve opens the inlet to the cylinder to admit steam when the piston in the cylinder is moving toward top dead center while feed water is simultaneously being injected into the cylinder to collect the braking energy by being formed into steam. This steam and its energy can then be collected by the steam buffer for future use by the steam engine.

19 Claims, 2 Drawing Sheets

ARRANGEMENT OF A STEAM ENGINE POWER PLANT

BACKGROUND OF THE INVENTION

1. Field of the Invention

The present invention relates to a device for a steam engine power plant that includes a steam generator, a steam buffer, and an adjustable valve for variable filling with forward and backward motion and having a supply of steam for a steam engine of a displacement type, especially an axial piston type engine.

2. Description of the Prior Art

For a steam engine, as for other engines, potential engine braking is desirable. For conventional engines, engine braking is obtained through pump losses, which do not exist in a steam engine, and mechanical losses, which are considerably higher than in a steam engine. Consequently, it is advantageous to provide a steam engine with an engine braking capability.

SUMMARY OF THE INVENTION

A steam engine power plant of the introductorily mentioned type is equipped with a steam buffer, and the invention is based on utilization of a steam buffer of the type which is described in detail in a pending application filed together with this application, entitled "Steam Buffer For A Steam Engine Plant" with U.S. Ser. No. 08/750,833, to which reference is made regarding details about the steam buffer. This steam buffer is equipped with a high temperature connection for steam, preferably with a temperature of 500° C. and a pressure of 250 bar, a low temperature connection for feed water, and a solid heat exchanging material with a large number of pressure resistant flow channels with a hydraulic diameter less than 0.5 mm for the steam and feed water between the two connections. It has been shown that an energy density of 500 kJ/kg and a power density of 100 kW/kg is possible to be obtained with this design, which can be compared with corresponding values for a lead-acid battery, for instance, which typically exhibit an energy density of only 10 kJ/kg and a power density of only 100 W/kg.

An object of the present invention is to provide a device according to the introductorily mentioned type having an efficient and preferably also regenerative engine braking capability which is simple and uncomplicated, and hence safe to operate.

This object can be achieved according to the present invention. By shifting the inlet valve for driving the engine in the opposite direction of rotation than the current direction of rotation, high pressure steam will start flowing into a cylinder in which the piston is moving up toward the top dead center. Hereby, very powerful engine braking is possible, but the steam, however, will pass through a process that, if no measures are taken, could result in heavy overheating and rapid meltdown of the steam engine plant. The solution to this overheating problem is to cool the high pressure steam during its admission to the cylinder to a nominal steam buffer temperature by injecting of cold feed water at least 80° C., that is available. Whereafter, the steam is permitted to flow into the steam buffer, which has a large capacity for absorbing the energy content of this steam for later use as needed. Hereby, a very effective braking function is obtained, which also is controllable from zero to very high power, and works in both directions of rotation of the engine.

BRIEF DESCRIPTION OF THE DRAWINGS

The invention is described in the following in more detail with reference to the attached drawings, which schematically illustrate one embodiment of a device according to the invention.

DESCRIPTION OF THE PREFERRED EMBODIMENT

Figure 1:
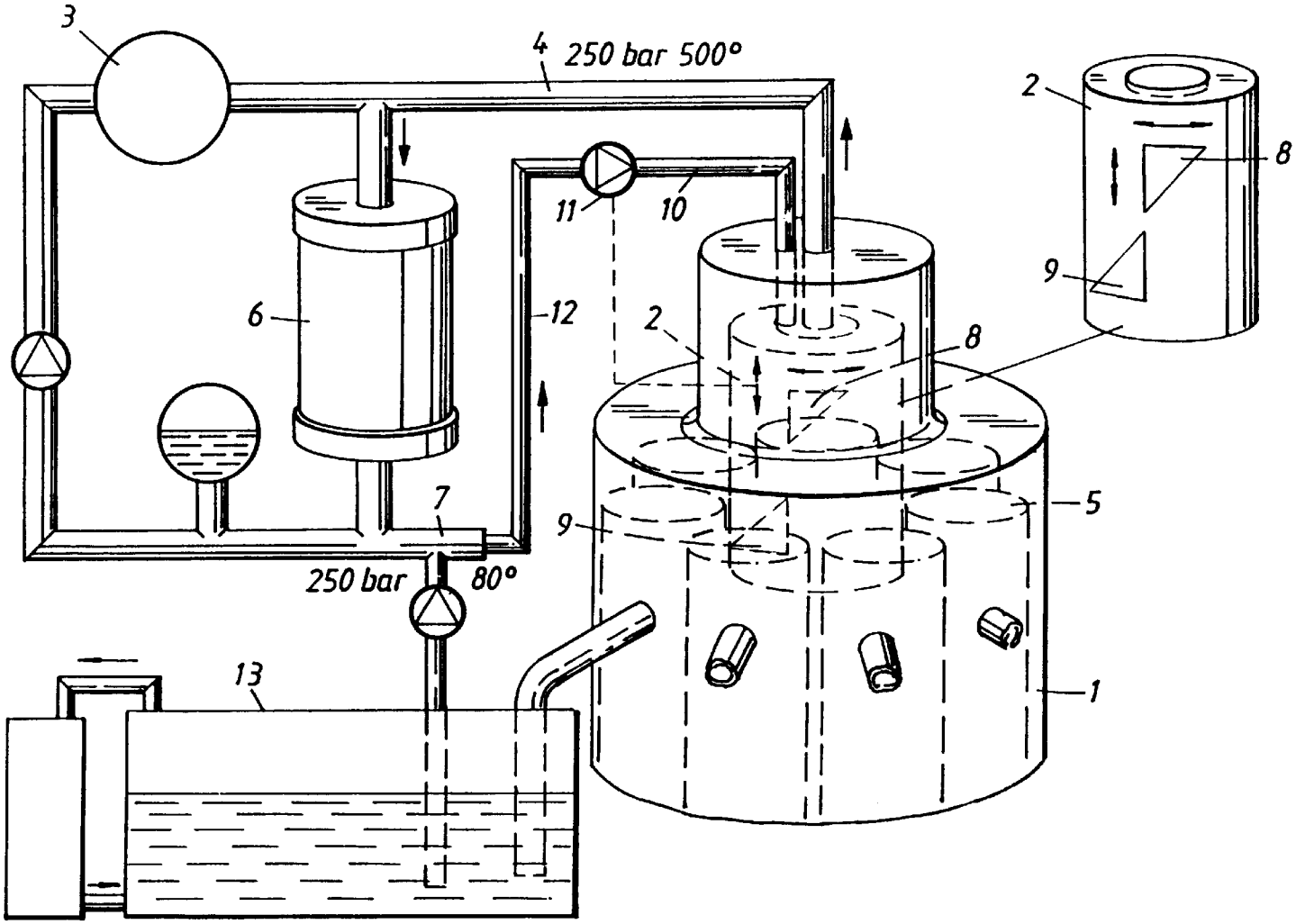
FIG. 1 illustrates a simplified perspective view of the parts of interest of the device.

FIG. 1 shows the main engine 1 in a steam engine plant and the other components to which it is directly connected. The engine 1, which is of an axial piston type, has a central rotating timing valve 2, which controls the steam supply. The steam supply has a pressure of 250 bar and temperature of 500° C. and is supplied from a steam generator 3 via a pipe 4 to all the cylinders 5 in sequence in the steam engine 1. The steam buffer 6 is connected between the pipe 4 and the pipe 7 which leads the feed water with a temperature of about 80° C. and pressure of 250 bar to the steam generator 3. The rotating timing valve 2 rotates synchronized with the engine shaft and is axially displaceable by a control device (not illustrated) which makes it possible to select that hole 8 or 9 or neither of them rotates in line with the inlet holes to the individual cylinders 5. The high pressure steam is supplied in the center of the rotating valve 2.

The steam supply forwarded to each cylinder 5 at normal operation will take place when each respective piston reaches the top dead center. When the piston in a cylinder has reached top dead center, the vertical edge of the triangular hole 8 of the valve 2 has reached exactly the inlet hole of the cylinder in question, and hence gives access of the high pressure steam to the cylinder in question. When the engine shaft and the timing valve rotate further, the piston starts to leave top dead center, and during its movement to bottom dead center the other edge of hole 8 of the valve will shut off the supply of steam. The process between the steam starting to enter the cylinder and the closing of the inlet valve is called the filling process, and the fraction calculated as a percentage of the total stroke for the distance the piston has been moved until the inlet valve is closed is called the cut-off. After the end of the filling process, the expansion process of the trapped steam takes place until the outlet ports in the cylinder liner are uncovered (not illustrated) at the end of the stroke. The valve 2 is axially displaceable which makes it possible to utilize different parts of the hole 8 for different cut-offs. Another hole 9 in the valve gives different cut-offs for reverse rotation when the engine is driven in reverse.

Figure 2:
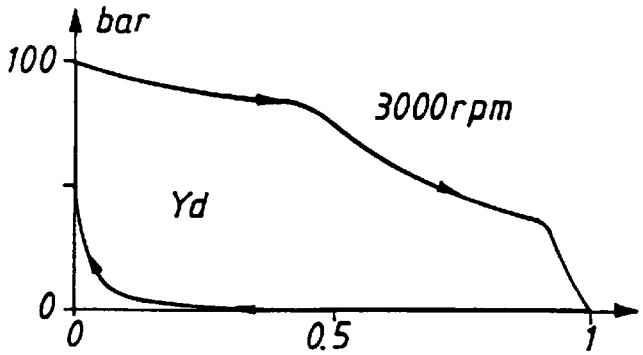
FIGS. 2 and 3 are graphical indicator diagrams for driving and braking, respectively.

Driving forward at a shaft speed of 3000 rpm gives an indicator diagram according to FIG. 2 with a surface Yd that is positive, because the process takes place clockwise, and with a magnitude that is dependent on the axial position of the valve 2 or the speed.

Figure 3:
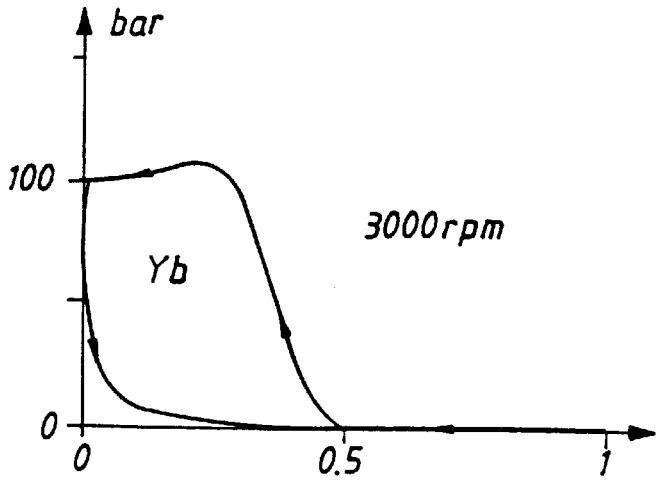
Figure 4:
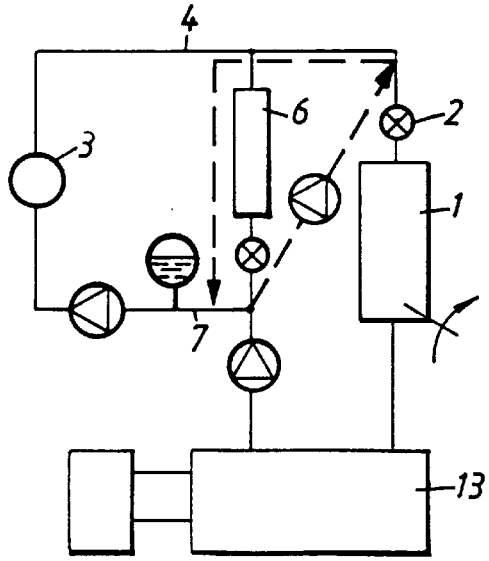
FIGS. 4 and 5 show the flow diagrams for two different braking processes.

When the valve is set for braking, that is, rotation of the valve in the opposite direction than the driving direction of rotation for each particular valve, the high pressure steam will enter a cylinder 5 when the piston is on its way upward towards top dead center. Feed water is injected with a temperature of approximately 80° C. into the cylinder inlet and the cylinder 5 via the inner of the valve 2, to which a pipe 10 leads from an outlet port of a dosage pump 11. The inlet of the pump 11 is connected by a pipe 12 to the feed water pipe 7, and the pump 11 is driven in synchronism with the braking adjustment of the valve 2 and is active during the braking. The steam will be cooled by the water and flows back to the steam buffer 6 together with the vaporized water with a temperature equal to the nominal temperature of the steam buffer. The energy content is stored in the steam buffer as the feed water is simultaneously pressed out from the steam buffer in a corresponding amount to be fed out to the pipe 7 and further to the dosage pump 11. The stored energy corresponds to the work Yb in FIG. 3. Since the process proceeds counterclockwise in FIG. 3, the work is negative and consequently gives a braking torque on the engine shaft. The braking work of the engine corresponds, in other words, to the energy stored in the steam buffer 6. The energy flow is schematically illustrated in FIG. 4.

Thus, the axial displacement of the rotating valve 2 gives a complete, so called, four quadrant control of the steam engine torque. It will give both driving and braking for forward as well as reverse motion of the engine.

Notable is that the quality or steam data of the steam which is supplied from the steam engine at braking, is equal with the nominal existing steam in the steam buffer. With respect to this fact, this engine brake function must not be confused with a, so called, exhaust braking, where the brake energy is throttled away and therefore can not be regenerated. According to the present invention, the thermodynamic function of the device at braking implies that the braking energy is transferred into the injected water.

The maximum torque when braking is about 70% of the maximum driving forward torque. A steam engine of the described type will have an extraordinarily high torque per displacement volume. Therefore, even a small steam engine can give as high amount of braking as the friction with the road permits when the wheels become locked.

Figure 5:
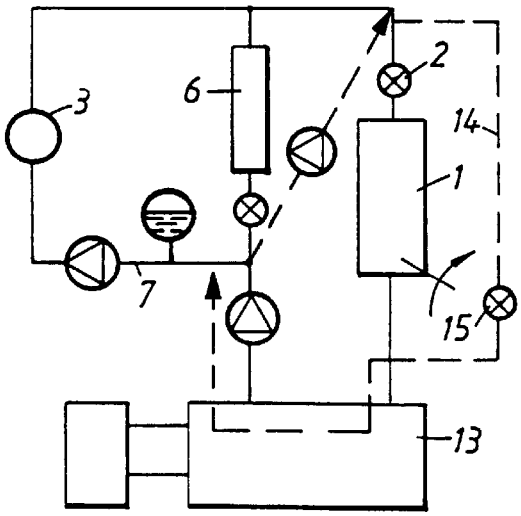

The regeneration of the braking energy is possible only as far as the steam buffer can receive the braking energy. When the steam buffer is fully loaded, the braking energy is fed to the condenser system 13 via a special pipe 14 that includes a throttle valve 15, as illustrated schematically in FIG. 5. The condenser system has an endurance for cooling which depends upon the velocity of the vehicle and especially the temperature of a conventional air cooled condenser. When driving, it is important to keep the condenser temperature as low as possible—nominal at 80° C.—on grounds of efficiency. When braking, this reason is, of course, not relevant. Therefore the condenser temperature may, in such a case, be allowed to increase, in which case the air cooled condenser will give a strongly increased cooling capacity.

I claim:

1. A steam engine plant comprising a steam generator, a steam buffer, an adjustable timing valve with a range of cut-offs for both forward and reverse motion of a displacement type steam engine and supplying steam to the steam engine, and engine braking means controlled by said timing valve when positioned for braking of the engine in an opposite direction of rotation than a driving direction of rotation and opening a steam admission to a cylinder of the steam engine when a piston of the cylinder is moving up toward top dead center, and said engine braking means including means for simultaneously injecting water into the cylinder until the piston has reached top dead center.

2. A device according to claim 1, wherein steam from the cylinder leads to the steam buffer for regeneration of braking energy and the injected water derives from feed water that is pressed away from the steam buffer.

3. A device according to claim 1, wherein steam from the cylinder is fed to a condenser system of the steam engine plant through a pipe including a throttle valve.

4. A device according to claim 1, wherein said means for water injection is arranged to inject feed water from the steam buffer by a dosage pump dependent upon braking power.

5. A device according to claim 1, wherein the steam engine is of an axial piston type, said timing valve is a rotating sleeve synchronized with the engine and is axially displaceable with two axially separated inlet ports in the wall of the sleeve for sequential supply of steam to cylinders of the steam engine to drive the engine in forward and backward direction dependent upon said selected inlet port and with a cut-off dependent upon an axial position of the valve.

6. A steam engine power plant, comprising a displacement type steam engine, a steam generator for supplying steam to said steam engine, a timing valve for regulating the supply of steam to said steam engine and synchronized with operation of said steam engine, and a steam buffer to store and release steam energy in said power plant and to receive braking energy from the steam engine.

7. A steam engine power plant of claim 6, wherein said timing valve rotates in a driving direction supplying steam to said steam engine to drive said engine and rotates in a braking direction supplying steam to said steam engine to brake said engine, said steam engine being provided with feed water while said timing valve rotates in the braking direction which absorbs braking energy to form steam.

8. A steam engine power plant of claim 7, wherein the steam derived from said braking energy is directed to said steam buffer to absorb the energy of the steam.

9. A steam engine power plant of claim 7, wherein said timing valve has a shape of a sleeve and is axially displaceable, said valve including a first and second axially spaced inlet ports for supplying steam to said steam engine, said first inlet port supplying steam to said engine when said steam engine is driven and operates in a forward direction, and said second inlet port supplying steam to said engine when said steam engine is driven and operates in a reverse direction.

10. A steam engine power plant of claim 9, wherein said first inlet port supplies steam to said engine when said engine is braking and operating in the reverse direction and said second inlet port supplies steam to said engine when said engine is braking and operating in the forward direction.

11. A steam engine power plant of claim 10, wherein said steam engine is an axial piston type engine and said first and second inlet ports supply steam to said engine when braking said engine at a point where a piston in a cylinder of said engine is moving toward a top dead center position.

12. A steam engine power plant of claim 7, wherein said steam engine is an axial piston type engine and said valve supplies steam to a cylinder of said engine while operating in the driving direction when a piston of said cylinder is advancing away from a top dead center position and while operating in the braking direction when said piston is advancing toward the top dead center position.

13. A steam engine power plant of claim 12, wherein the feed water is supplied simultaneously into said engine with the steam when said valve is rotating in the braking direction.

14. A steam engine power plant of claim 7, wherein said valve includes a first and second inlet port to supply steam to said cylinder, said first port supplying steam to provide the driving of said engine and said second port supplying steam to provide the braking of said engine.

15. A steam engine power plant, comprising a displacement type steam engine with at least one cylinder and cooperating piston, a valve for regulating entry of steam to said cylinder and synchronized with operation of said steam engine, a steam buffer for absorbing and storing steam energy and releasing steam for use by said engine, and a feed water supply to said engine to absorb braking energy of said engine and produce steam to be directed to said buffer.

16. A steam engine power plant of claim 5, wherein said valve has a cylindrical shape with two axially spaced inlet ports to feed steam to said cylinder, a first port of said spaced inlet ports provides steam to drive said engine and a second port of said spaced inlet ports provides steam to brake said engine.

17. A steam engine power plant of claim 16, wherein said valve permits entry of steam into said cylinder when said piston travels away from a top dead center position to provide driving for said engine and when said piston travels toward the top dead center position to provide braking for said engine.

18. A steam engine power plant of claim 16, wherein said engine operates in both a forward and a reverse direction.

19. A steam engine power plant of claim 16, wherein said valve has the form of a sleeve and includes first and second axially spaced inlet ports supplying steam to said steam engine, said first inlet port supplies steam to drive said engine in the forward direction and to brake said engine when operating in the reverse direction, and said second inlet port supplies steam to drive said engine in the reverse direction and brake said engine when it operates in the forward direction.

* * * * *